US006401608B1

(12) United States Patent
Lyon et al.

(10) Patent No.: US 6,401,608 B1
(45) Date of Patent: Jun. 11, 2002

(54) PRINTING PRESS WITH PERFECTING STATION

(75) Inventors: Donald F. Lyon, Laurel Hollow, NY (US); Roger D. Star, St. Charles, IL (US); Karl Hansen, Sea Cliff, NY (US); Michael I. Tilman, New York, NY (US); Salvatore DiRosa, Middle Village, NY (US)

(73) Assignee: Halm Industries, Co., Inc., Glen Head, NY (US)

( * ) Notice: Subject to any disclaimer, the term of this patent is extended or adjusted under 35 U.S.C. 154(b) by 0 days.

(21) Appl. No.: 09/565,319

(22) Filed: May 5, 2000

(51) Int. Cl.[7] ..... B41F 5/02

(52) U.S. Cl. ..... 101/136; 137/229; 137/424.1

(58) Field of Search ..... 101/229, 216, 101/217, 218, 219, 136, 137, 142, 424.1

(56) References Cited

U.S. PATENT DOCUMENTS

| | | | | | |
|---|---|---|---|---|---|
| 1,065,228 | A | | 6/1913 | Elsworth | |
| 1,106,472 | A | | 8/1914 | Pancoast | |
| 1,470,344 | A | | 10/1923 | Barber | |
| 1,709,575 | A | | 4/1929 | Horn | |
| 2,540,690 | A | * | 2/1951 | Pritchard | 101/142 |
| 2,546,793 | A | * | 3/1951 | Sodomka | 101/142 |
| 2,650,291 | A | | 8/1953 | Kinn | |
| 2,789,499 | A | | 4/1957 | Dietrich | |
| 2,865,288 | A | | 12/1958 | Kaldschmidt | |
| 3,384,011 | A | | 5/1968 | Bolza-Schunemann | |
| 3,446,142 | A | | 5/1969 | Vandenberg | |
| 3,661,079 | A | | 5/1972 | Stapleford | |
| 3,690,253 | A | | 9/1972 | Dreyer | |
| 3,742,849 | A | | 7/1973 | Greiner | |
| 3,848,320 | A | | 11/1974 | Davidson, Jr. | |
| 4,137,844 | A | | 2/1979 | Paulson | |
| 4,312,137 | A | | 1/1982 | Johne et al. | |
| 4,321,869 | A | * | 3/1982 | Jeschka et al. | 101/136 |
| 4,471,695 | A | | 9/1984 | Ishii | |
| 4,574,696 | A | | 3/1986 | Giori | |
| 4,587,897 | A | * | 5/1986 | Fischer | 101/137 |

(List continued on next page.)

FOREIGN PATENT DOCUMENTS

| | | | |
|---|---|---|---|
| DE | 271645 | | 4/1913 |
| DE | 1235953 | | 3/1967 |
| DE | 2237567 | | 2/1974 |
| DE | 19505877 | A1 | 8/1996 |
| DE | 19822894 | A1 | 11/1999 |
| DE | 19839875 | A1 | 3/2000 |
| EP | 1151861 | A2 | 11/2001 |

OTHER PUBLICATIONS

Envelopmaster—Series EM 4000 brochure, Halm Industries Co., Inc. (undated).

*Primary Examiner*—Eugene Eickholt
(74) *Attorney, Agent, or Firm*—Hoffman & Baron, LLP

(57) ABSTRACT

A printing press including a frame and a central impression drum rotatably supported on the frame. A plurality of first side printing stations is circumferentially spaced about the central impression drum and in communication therewith. Each of the plurality of printing first side printing stations is adapted to print an image on a first side of a substrate. A perfecting printing station is disposed at a position about the central impression drum. The perfecting printing station includes a multi-purpose drum having a substrate retainer for securing the substrate thereto. The multi-purpose drum forms an impression cylinder and is in communication with an image transfer cylinder for imparting an image on a second side of the substrate. An ink fixing unit is disposed between the first side printing stations and the perfecting station. The ink fixing unit fixes the image on the first side of the substrate prior to the image being imparted on the second side of the substrate by the perfecting station.

33 Claims, 13 Drawing Sheets

U.S. PATENT DOCUMENTS 4,603,631 A 8/1986 Simeth
4,616,564 A 10/1986 Faddis et al.
4,794,856 A 1/1989 Giori
4,967,658 A 11/1990 Townsend
4,967,660 A 11/1990 Yamanari et al.
4,976,197 A 12/1990 Yamanari et al.
4,986,522 A 1/1991 Paulson
5,379,697 A 1/1995 Ertl
5,406,884 A * 4/1995 Okuda et al. ..... 101/137
5,447,566 A 9/1995 Loiacono
5,471,924 A 12/1995 Helling
5,479,856 A 1/1996 Wirz
5,535,673 A 7/1996 Bocko et al.
5,544,582 A 8/1996 Bocko et al.
5,595,115 A 1/1997 Rau et al.
5,595,118 A 1/1997 Villaverde, Sr. et al.
5,692,439 A 12/1997 Wech
5,727,472 A * 3/1998 Burgio ..... 101/424.1
5,778,781 A 7/1998 Mueller
5,797,324 A * 8/1998 Schoppe et al. ..... 101/424.1
5,979,325 A 11/1999 Mitze et al.
6,062,136 A * 5/2000 Bolza-Schüneman ..... 101/137

* cited by examiner

PRINTING PRESS WITH PERFECTING STATION

FIELD OF THE INVENTION

The present invention relates to a printing press having a perfecting station. More specifically, the present invention relates to a printing press having a perfecting station wherein the perfecting station includes a multi-purpose drum for printing and transferring a printed substrate. The present invention also relates to a printing press having a printing unit which is easily accessible in order to perform necessary maintenance procedures.

BACKGROUND OF THE INVENTION

Printing presses that are capable of printing an image on both sides of a sheet are well known in the art. One way in which two sided printing has been achieved was by running a sheet between two blanket cylinders which simultaneously print the front and reverse side of the sheet as it passes there between. It is also known to send a sheet through a printing press in which the first side of a sheet is printed and then reversing the sheet and sending it through to print on the reverse side of the sheet. Printing on the reverse or backside of a sheet is referred to as perfecting. Prior art two sided printing machines are shown in U.S. Pat. Nos. 4,471,695 and 4,621,576.

Linear type printing presses that print a sheet at various stations along a conveyer are also known. Such presses are able to perfect a sheet by adding a perfecting printing station to the line either before or after the front side printing stations. However, these types of linear presses consume a considerable amount of floor space and are not practical for small shops. Set up and maintenance of these presses is also fairly time consuming.

In order to minimize press size and conserve floor space, it has been known to print sheets attached to a central impression drum. Sheets traveling on the central impression drum travel past various printing stations where an image is imparted onto the sheets. U.S. Pat. No. 4,967,660 discloses a central impression drum type printing press that is capable of printing on both sides of a sheet. In the '660 patent, the discharge cylinder both assists in transporting the sheet from the main impression cylinder to outside the press and acts as an impression cylinder for the perfecting of the sheet. The discharge cylinder works in cooperation with a sprocket and endless chain, the chain carrying a plurality of mechanical grippers. The grippers are carried by the chain rotate over the discharge cylinder and capture the sheet from the central impression cylinder. The grippers then carry the sheet over the discharge drum to a point where it passes between the discharge drum and blanket cylinder. After perfecting is completed, the printed sheet is carried by the chain driven grippers until it is deposited in a finished sheet collection point. While the surface of the discharge drum is used as an impression cylinder, a separate mechanism including the grippers, endless chain and sprocket, is required in order to transport and discharge the paper. In addition, in order to accommodate the chains and mechanical grippers, a notch must be formed in the discharge cylinder. Due to this complicated construction, maintenance of the perfecting unit could be rather involved. Removal of the discharge cylinder in order to clear a jam or clean the impression cylinder surface would require removal of the chains and/or sprocket resulting in a time consuming operation.

In addition, the sheet after being printed on the first side proceeds directly to the perfecting station without processing by a dryer or other type of ink fixing unit. Accordingly, the image on the first side must air dry sufficiently before it contacts the exit drum to prevent smearing of the image. Therefore, the speed at which sheets are printed is limited by the drying time of the ink.

Printing presses are also known for their need for frequent maintenance which may include removing sheets after a jam is detected. Maintenance includes cleaning the various blanket cylinders and other interior areas of the press in order to ensure a quality output. While performing servicing, it is important that the press be down for as short of time possible in order for the maximum efficiency of the press to be realized. In printing presses having a central impression drum and a plurality of individual printing units spaced thereabout, access to various parts of the press becomes an issue. Since this type of press is a rather compact unit it is often difficult to get to the various areas in which maintenance needs to be formed. For example, in printing presses in which a dryer is installed between two of the printing stations, the dryer must often be removed in order to gain access to the interior portions of the press for maintenance. Removal of the dryer can require unfastening a variety of fastening hardware and then physically lifting the dryer off of the unit and placing it somewhere where it will be safely stored. Once maintenance is completed, the unit must then be placed back into position and refastened to the machine. Such an operation of simply removing the dryer to gain access can be rather involved and take a significant amount of time.

Accordingly, it would be desirable to provide a printing press that is capable of printing on the front and reverse side of a substrate wherein the exit or discharge cylinder includes a sheet attachment mechanism formed thereon and the exit cylinder also functions as an impression cylinder for a perfecting printing unit. It would also be desirable to provide a printing press which is easily maintainable and provides quick and easy access to all areas such that scheduled and unscheduled maintenance may be quickly performed thereby reducing the downtime of the press.

SUMMARY OF THE INVENTION

It is an advantage of the present invention to provide a printing press having a perfecting station to permit printing on both sides of a substrate.

It is another advantage of the present invention to provide a printing press having an ink fixing device rotatably secured to the press to allow case of maintenance. The ink fixing device may be positioned between a first side printing station and the perfecting station in order to fix the ink on the first side of a substrate prior to perfecting.

It is a further advantage of the present invention to provide a printing press having a perfecting station including a multi-purpose drum which performs the functions of both an exit drum and an impression drum.

It is still a further advantage of the present invention to provide a printing press having a delivery table translatable between an extended and a retracted position to permit operator access to aid in servicing the press.

These and other advantages of the present invention may be obtained by providing a printing press including a frame and a central impression drum rotatably supported on the frame. A plurality of first side printing stations is circumferentially spaced about the central impression drum and in communication therewith. Each of the plurality of printing first side printing stations is adapted to print an image on a first side of a substrate. A perfecting printing station is disposed at a position about the central impression drum. The perfecting printing station includes a multi-purpose drum having a substrate retainer for securing the substrate thereto. The multi-purpose drum forms an impression cylinder and is in communication with an image transfer cylinder for imparting an image on a second side of the substrate. An ink fixing unit is disposed between the first side printing stations and the perfecting station. The ink fixing unit fixes the image on the first side of the substrate prior to the image being imparted on the second side of the substrate by the perfecting station.

The present invention may also provide a printing press including a printing unit. The printing unit including a frame and a central impression drum rotatably supported on the frame adapted to transport a sheet. A plurality of first side printing stations is circumferentially spaced about the central impression drum and in communication therewith. The first side printing stations are adapted to impart an image to a first side of the sheet being transported by the central impression drum. A perfecting printing station is disposed at a point about the central impression drum sequentially after the plurality of first side printing stations for imparting an image to a second side of the sheet. The perfecting printing station includes a multi-purpose drum having a first sheet retainer attached thereto for securing the sheet to the multi-purpose drum. The multi-purpose drum forming an impression cylinder and being in rolling communication with an image transfer cylinder for printing an image on the second side of the sheet.

The present invention may further provide a printing press including a frame and a central impression drum rotatably supported on the frame and adapted to transport a sheet. A plurality of first side printing stations are circumferentially spaced about the central impression drum and in communication therewith for printing an image on a first side of a substrate. An ink fixing device for fixing the image on the first side of the substrate is pivotally secured to the frame and rotatable between a first position and a second position.

The present invention may still further provide a printing press including a printing unit for imparting a printed image to a substrate. The printing unit includes an exit station from which a printed substrate exits the printing unit. A delivery table is positioned adjacent the exit station for receiving and transporting the printed substrate. The delivery table is translatable between an extended position wherein the delivery table is in operative communication with an exit station of the printing unit and a retracted position wherein when the delivery table is in the retracted position operator access between the printing unit and the output table is provided.

A preferred form of the printing press, as well as other embodiments, objects, features and advantages of this invention, will be apparent from the following detailed description of illustrative embodiments thereof, which is to be read in connection with the accompanying drawings.

DETAILED DESCRIPTION OF PREFERRED EMBODIMENTS

The present invention includes a printing press having the ability to print on the front and reverse side of a substrate such as a sheet or envelope without requiring the substrate to be unduly manipulated. The printing press of the present invention is particularly suited for the high speed printing of envelopes. The printing on both sides is achieved in a single pass through the press thereby eliminating the need to re-feed the work through the press. The present invention also fixes the ink on the first side prior to perfecting the sheet. The printing press of the present invention is therefore, capable of high speed and high quality output. In addition, printing presses typically require frequent scheduled and unscheduled maintenance. Scheduled maintenance may involve cleaning the blanket cylinders and impressions cylinder as well as other components. Unscheduled maintenance may include clearing jams and mis-feeds that occur. The present invention permits the press to be quickly and easily serviced thereby reducing any maintenance related downtime.

Figure 1:
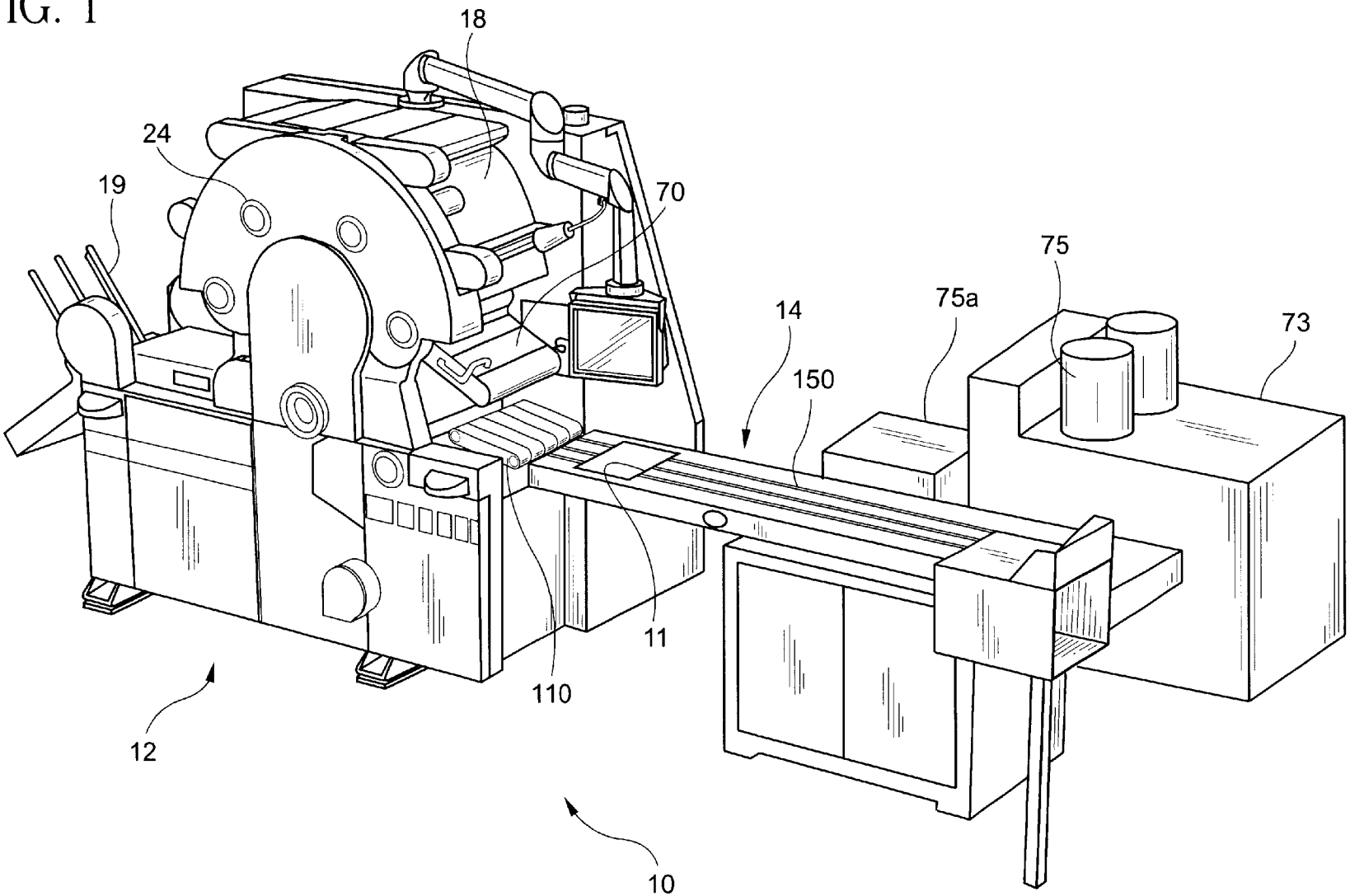
FIG. 1 is a top perspective view of the printing press of the present invention.

A preferred embodiment of printing press 10 of the present invention is shown in FIG. 1. Printing press 10 generally includes a printing unit 12 that may transfer an image to a front and reverse sides of a substrate 11 by an offset printing process. The finished work is transported to a delivery table 14 where it may be collected for further processing. Throughout this specification, the terms front and reverse side of a sheet are used only to refer to a first and second side of a sheet and not any particular orientation of the surface of a sheet or printable substrate.

Figure 2:
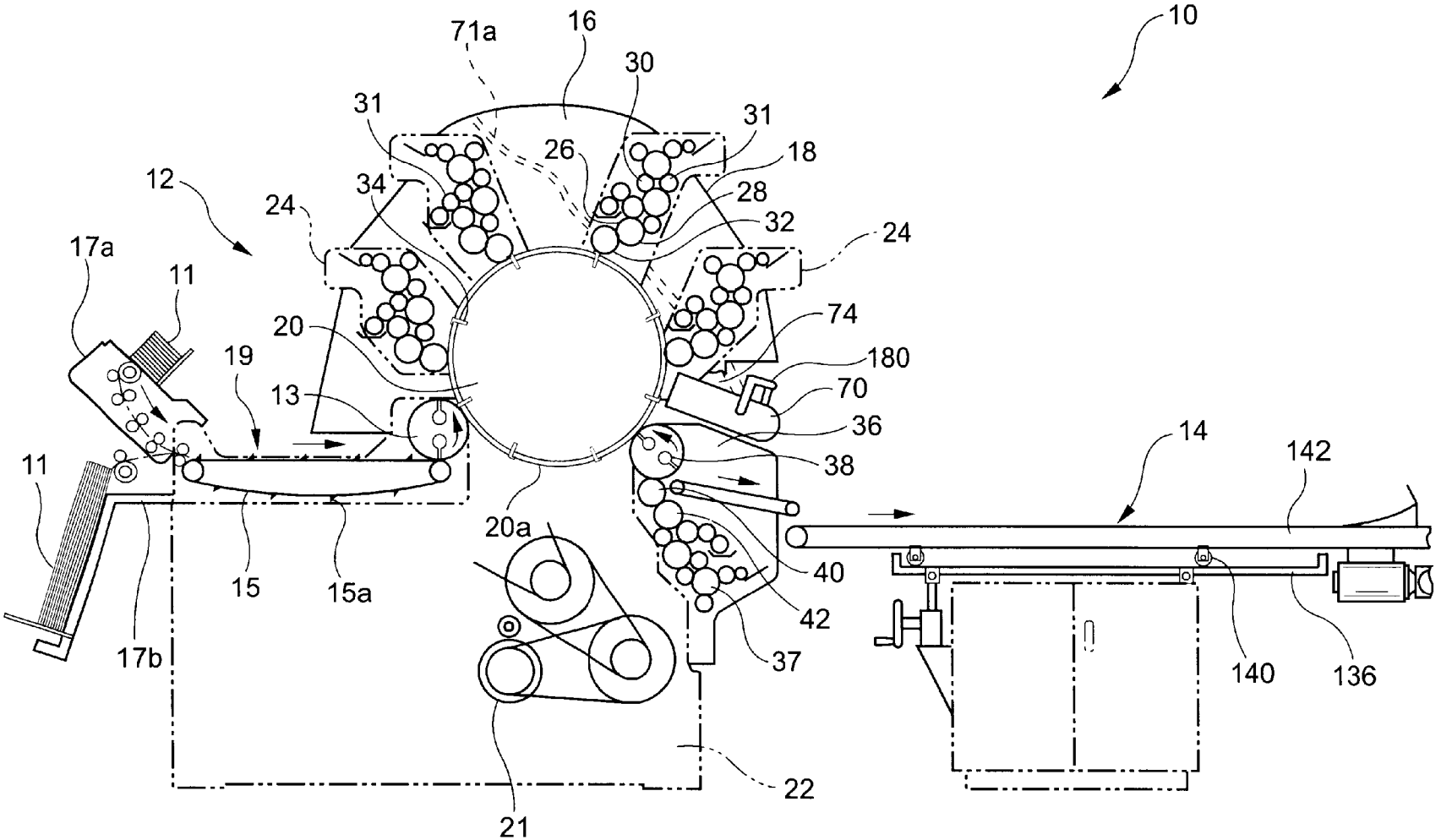
FIG. 2 is a side elevational schematic view of the printing unit of FIG. 1.

Referring additionally to FIG. 2, printing unit 12 preferably includes a material in-feed mechanism 19 that transfers sheets of material 11 to be printed into a printing chamber 16. In-feed mechanism 19 may include a pair of spaced endless chains 15 including upstanding pushers 15*a* and an in-feed drum 13 for transporting the material from an upper feeder 17*a* or a lower feeder 17*b* to a printing chamber 16 where the printing occurs. A housing 18 at least partially surrounds printing chamber 16. Printing chamber 16 may include a central impression drum 20 rotatably secured to a frame 22. Central impression drum 20 is operatively connected to a drive mechanism 21 that continuously rotates the central impression drum 20 during the printing operation. A resilient blanket material 20*a* substantially surrounds a printing surface of central impression drum 20 to provide the proper backing for a sheet upon printing. Central impression drum 20 may further include a plurality of mechanical grippers 34 spaced about its circumference. Grippers 34 selectively engage a leading edge of the sheet off of in-feed drum 13 and secure the sheet to the central impression drum as it rotates through printing unit 12.

Also disposed within printing chamber 16 is a plurality of front side printing stations 24 that are circumferentially spaced about central impression drum 20. In the preferred embodiment, four first side printing stations 24 may be employed to provide a four color press capability. Front side printing stations 24 cooperate with central impression drum 20 to transfer an image to the front side of sheet 11 as it passes there between. Each front side printing station 24 includes a plate cylinder 26 and blanket cylinder 32 and ink fountain mechanism 30. Vibration dampening rollers may also be included as is well known in the art. Plate cylinder 26 supports a printing plate 28, and ink is transferred from ink fountain mechanism 30 by various inking rollers 31 onto printing plate 28. Printing plate 28 transfers an image onto blanket cylinder 32 which then imparts the image onto sheet 11 as it travels between blanket cylinder 32 and central impression drum 20. This operation is typical for an offset printing process. Printing stations 24 may each impart a different color and/or image to the sheet thereby providing a wide range of colors which may be created as well known in the art. The printing unit as heretofore described including the four first side printing stations may be similarly constructed as a type well known in the art marketed by assignee, Halm Industries Co., Inc., under the name Envelopemaster, Series EM 4000.

Figure 3:
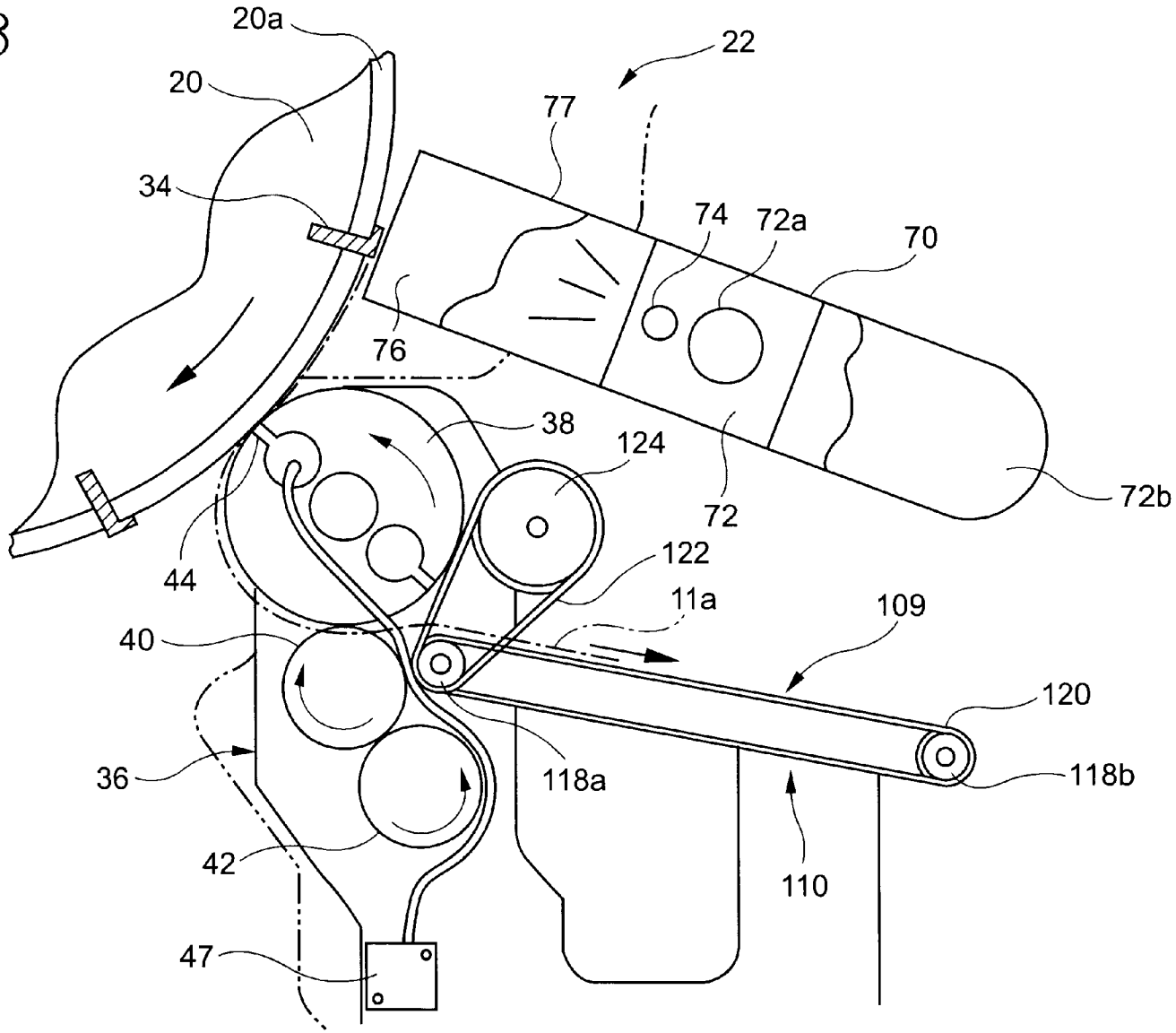
FIG. 3 is a side elevational schematic view the perfecting station of the printing unit of FIG. 2.

Referring to FIGS. 2 and 3, printing unit 10 further includes a perfecting station 36 for printing on the reverse side of a sheet prior to the sheet exiting printing chamber 16. Printing on the reverse side of a sheet, known as perfecting, is achieved without a complicated mechanism for turning over the sheet or having to send the sheet through a second printing process further down the line. Perfecting station 36 is preferably disposed about central impression drum 20 at a point sequentially after the front side printing stations. Therefore, the printing of the front side of the sheet will be completed prior to the image being printed on the reverse side of the sheet. Perfecting station 36 preferably includes a multi-purpose drum 38 that performs the function of both a sheet transferring exit drum and an impression drum for providing an image to the reverse side of the sheet. Perfecting station 36 may also include an ink fountain mechanism 37 having a variety of inking rollers and dampening rollers and a blanket cylinder 40 and a plate cylinder 42 of the type used in the first side printing stations 24. It is also within the contemplation of the present invention to provide a perfecting station having a plurality of ink fountain mechanisms and blanket and plate cylinder combinations disposed in operative communication with multi-purpose drum 38 in order to print multiple images or colors on the reverse side of the sheet.

In its role as an impression drum, multi-purpose drum 38 functions in cooperation with blanket cylinder 40 and plate cylinder 42 in an offset process to print the reverse side of the sheet. Accordingly, sheet 11 passing between multi-purpose drum 38 and its corresponding blanket cylinder 40 receives an image on the reverse side of the sheet. If a plurality of blanket and plate cylinders are provided, multiple colors or images may be transferred to the sheet.

Figure 4:
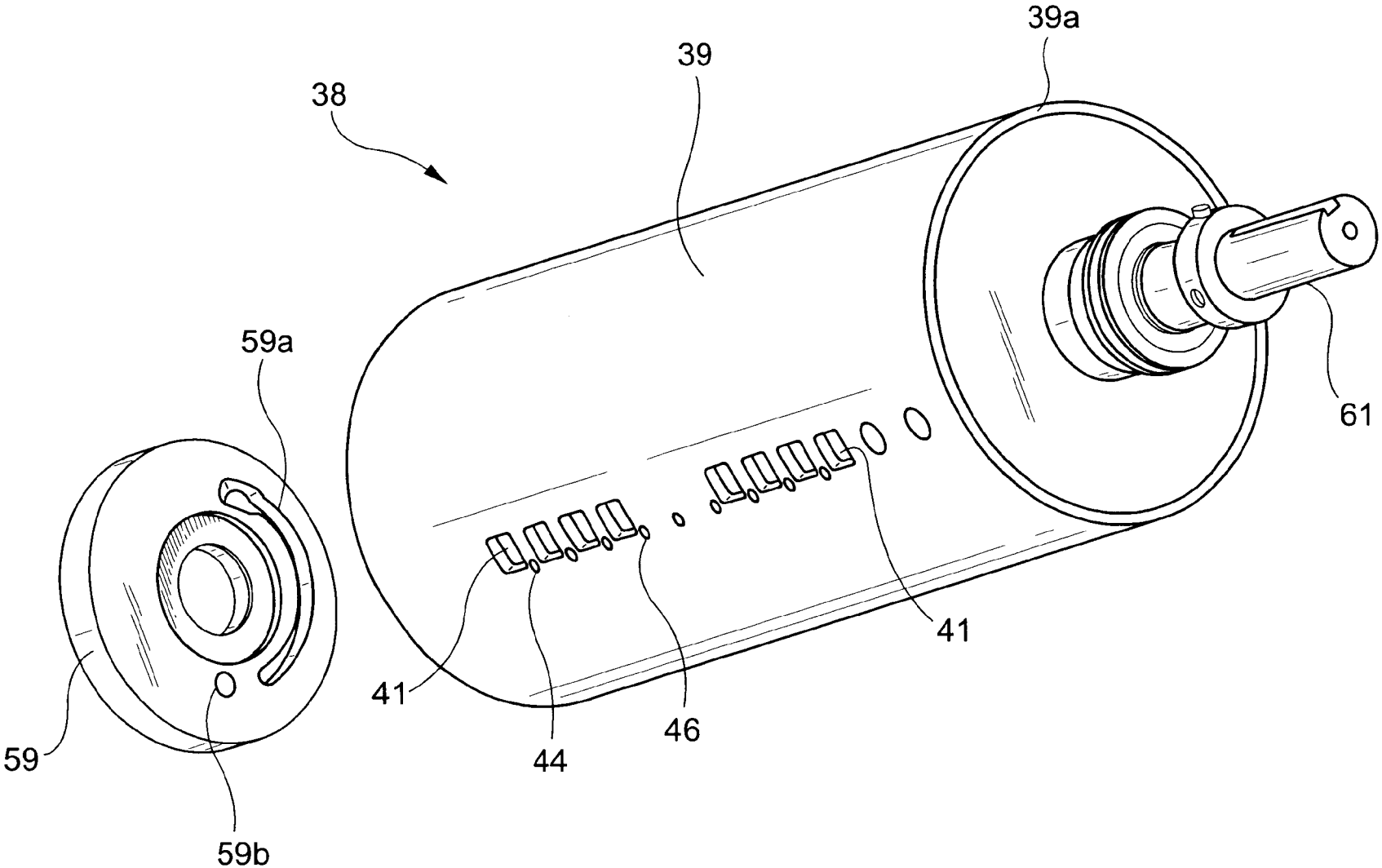
FIG. 4 is a first side exploded perspective view of the multi-purpose drum of the present invention.
Figure 5:
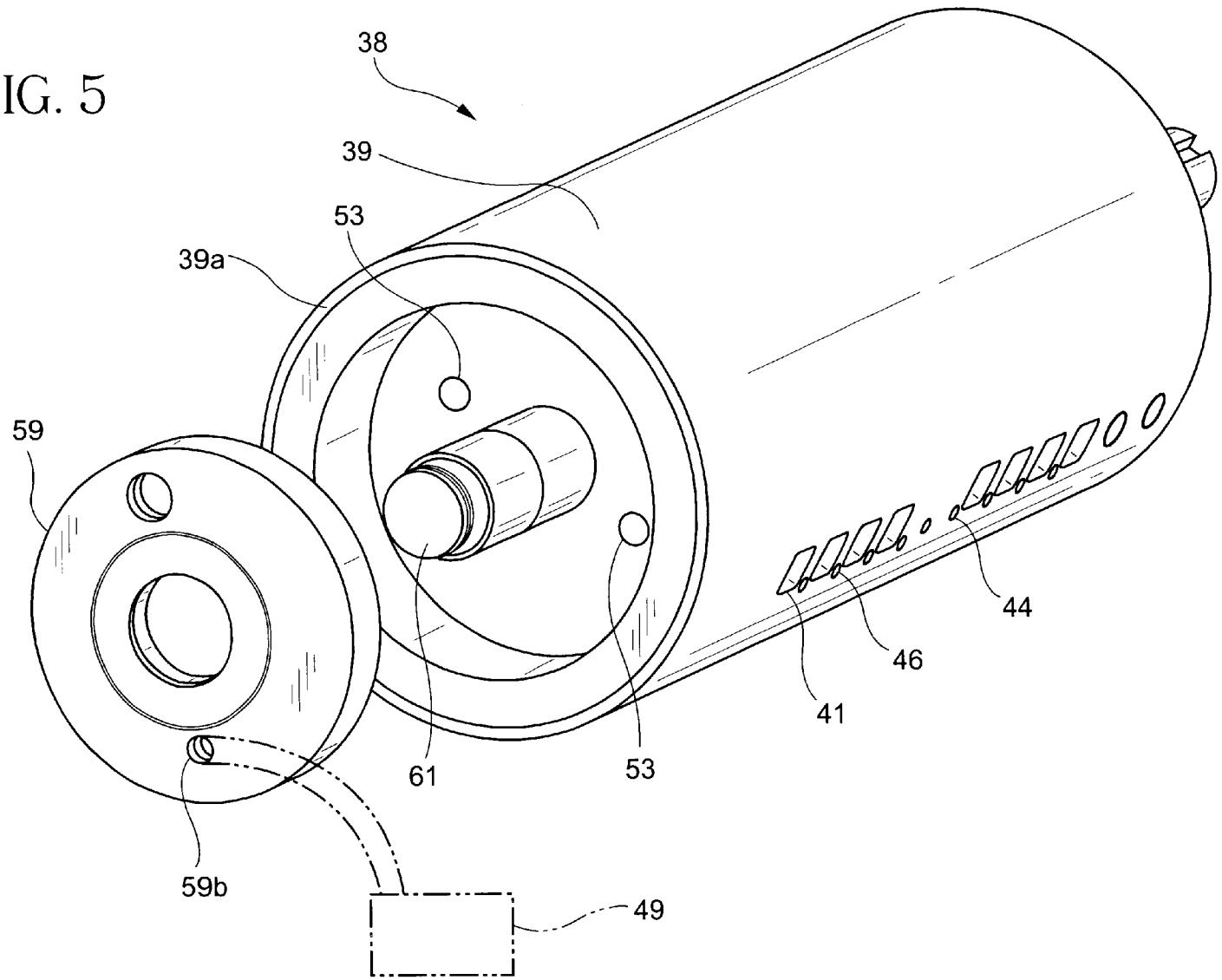
FIG. 5 is a second side exploded perspective view of the multi-purpose drum of FIG. 4.
Figure 6:
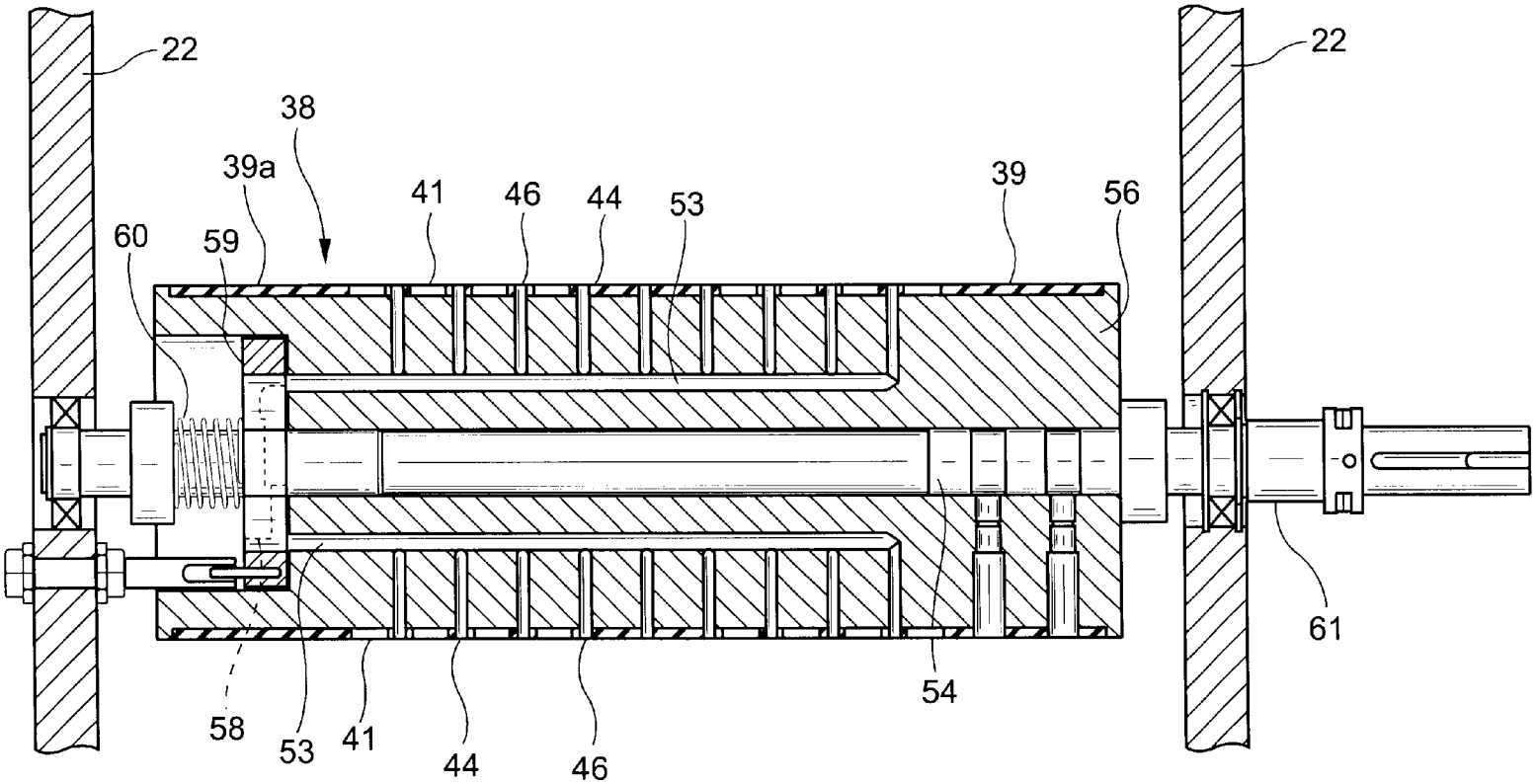
FIG. 6 is a cross-sectional view taken along the length of the multi-purpose drum of the present invention.

Referring to FIGS. 4, 5 and 6, multi-purpose drum 38 preferably includes a substantially continuous peripheral surface 39 in order to provide the necessary support to the sheet while it is being printed. A resilient blanket material 39*a* similar to the material found on the various blanket cylinders 32,40 and central impression drum 20 substantially covers peripheral surface 39. Multi-purpose drum 38 is rotatably secured within printing unit 12 such that it is in rolling contact with central impression drum 20. To accommodate this engagement, multi-purpose drum 38 includes a row of spaced pockets 41 extending along a portion of the width of multi-purpose drum 38. Pockets 41 are spaced such that they align with the mechanical grippers 34 protruding from central impression drum 38 thereby providing clearance for grippers 34.

A sheet 11 traveling on central impression drum 20 is picked up by multi-purpose drum 38 and is transferred past blanket cylinder 40 in order to print on the reverse side of the sheet. In order to remove the sheet from the central impression and carry it through perfecting station 36, multi-purpose drum 38 includes a sheet retainer 44 that selectively secures a sheet to multi-purpose drum 38. With additional reference to FIG. 3 where the path of sheet 11 is represented by dotted line 11*a*, when central impression drum 20 reaches a point in its rotation where the leading edge of a sheet approaches multi-purpose drum 38, grippers 34 release. At that point, sheet retainer 44 secures the leading edge of the sheet. The sheet is then attached to multi-purpose drum 38 and is transported off of central impression drum 20 toward perfecting blanket cylinder 40. Grippers 34 and sheet retainer 44 preferably engage the same leading edge portion of the sheet. Accordingly, the effective printing area of the sheet is not reduced by the use of two different sheet securement devices during the printing process. Upon the transfer, the printed first side of the sheet becomes positioned against the peripheral surface of multi-purpose drum 38. The unprinted reverse side of the sheet is then positioned for engagement with the image carrying perfecting blanket cylinder 40.

In the preferred embodiment, multi-purpose drum 38 is twice the diameter of the corresponding blanket cylinder 40. Accordingly, two sheets may be printed upon one revolution of multi-purpose drum 38 to facilitate high output of printed material. In order to permit a plurality of sheets to be processed simultaneously, the multi-purpose drum may include two sets of pockets 41 and a pair of sheet retainers 44 substantially diametrically opposed from one another on multi-purpose drum 38. It is also within the contemplation of the present invention that multi-purpose drum 38 may have the same diameter as blanket cylinder 40. Alternatively, the multi-purpose drum 38 diameter may be 3, 4, etc. times larger then the diameter of the blanket cylinder to process a plurality of sheets upon a single revolution.

Sheet retainers 44 are preferably attached to multi-purpose drum 38 and remain on drum 38 throughout the rotation thereof. In the preferred embodiment, sheet retainers 44 are preferably operated by vacuum. Each sheet retainer 44 includes a row of vacuum ports 46 integrally formed on drum 38 extending along drum 38 adjacent the row of gripper receiving pockets 41. Vacuum ports 46 are in fluid communication with a vacuum source 47 (FIG. 3) of a type well known in the art. Vacuum is selectively applied to ports 46 such that multi-purpose drum 38 can capture and release the sheet at the appropriate moments of the operation. Vacuum ports 46 are aligned such that they capture the leading edge of the sheet at the time when mechanical grippers 34 of central impression drum 20 release the sheet. As the sheet rotates on central impression drum 20 and approaches the multi-purpose drum 38, grippers 34 release and vacuum is supplied to vacuum ports 46. The sheet is then transported by multi-purpose drum 38 over blanket cylinder 40 whereby the image is transferred to the reverse side of the sheet. As multi-purpose drum 38 rotates carrying the sheet beyond blanket cylinder 40, the vacuum is then turned off to vacuum ports 46 in order to release the sheet.

Multi-purpose drum 38 preferably includes outer surface 39 and a central aperture 54 connected by an annular wall 56. Extending along a portion of the length of annular wall 56 is a pair of channels 53 in fluid communication with one of the two sets of vacuum ports 46. Channels 53 are open at one end of multi-purpose drum 38 and in communication with a valve 58. Central aperture 54 accommodates a transmission shaft 61 that drives drum 38. In order to selectively control vacuum to ports 46, valve 58 may be operatively disposed between the vacuum source and vacuum ports 46. Valve 58 preferably includes a disc 59 having an arcuate slot 59*a* and port 59*b* formed therein. Disc 59 may be urged against the end face of multi-purpose drum 38 by a biasing device 60 such as a helical spring. Slot 59*a* may be connected to a vacuum source and port 59*b* may be connected to atmosphere. Valve 58 remains stationary and multi-purpose drum 38 rotates relative thereto. Over a portion of the rotation of multi-purpose drum 38, slot 59*a* is also in communication with one of the pair of channels 53. Therefore, one set of vacuum ports 46 carries vacuum for securing the sheet to multi-purpose drum 38. Upon continued rotation the channel which was carrying vacuum comes into alignment with port 59*b* thereby releasing the vacuum and the sheet. Continued rotation of drum 38 brings the other channel 53 into alignment with slot 59*a* permitting the other set of vacuum ports to retain another sheet. Accordingly, the rotation of multi-purpose drum 38 results in vacuum ports 46 cyclically carrying vacuum followed by atmospheric pressure.

Once a sheet is released by retainers 44, an exit stripper assembly 63 (FIG. 8) may be positioned adjacent multi-purpose drum 38 to blow the sheet off drum 38 and ensure separation of the sheet from drum 38. Such exit strippers assemblies for providing an air blast at the appropriate moment are well known in the art. In an alternative embodiment, in order to ensure sheet separation, port 59*b* may be selectively operatively connected to a positive pressure generating device 49. Vacuum ports 46 would then carry pressurized air to blow the sheet off of multi-purpose drum 38 at the appropriate time. Therefore, vacuum ports 46 are in communication with a vacuum source over a first part of the rotation of multi-purpose drum 38 to retain the sheet and in communication with a positive pressure source over a second part of the rotation of multi-purpose drum 38 to release the sheet.

It is also within the contemplation of the present invention that sheet retainer 44 may include mechanical grippers attached to multi-purpose drum 38. Such grippers would selectively open and close to capture and release a sheet at the appropriate times. Sheet retainer 44 may also be in the form of an electrostatic charge imparted to the multi-purpose drum. The multi-purpose drum or a portion thereof could be charged to attract a sheet to pull the sheet away from the central impression drum. After the perfecting is completed, a reverse charge could be applied to the multi-purpose drum to release the sheet therefrom.

Multi-purpose drum 38 of the present invention, by way of the attached sheet retainer 44, itself secures and transports the sheet through the perfecting stage and out of the printing chamber 16. In contrast to prior art presses, no additional grippers or chains including the elements necessary to operate same are required in order to secure and transport the sheet through the perfecting operation. The present invention, therefore, simplifies the perfecting process from both a manufacturing and maintenance standpoint.

Figure 7:
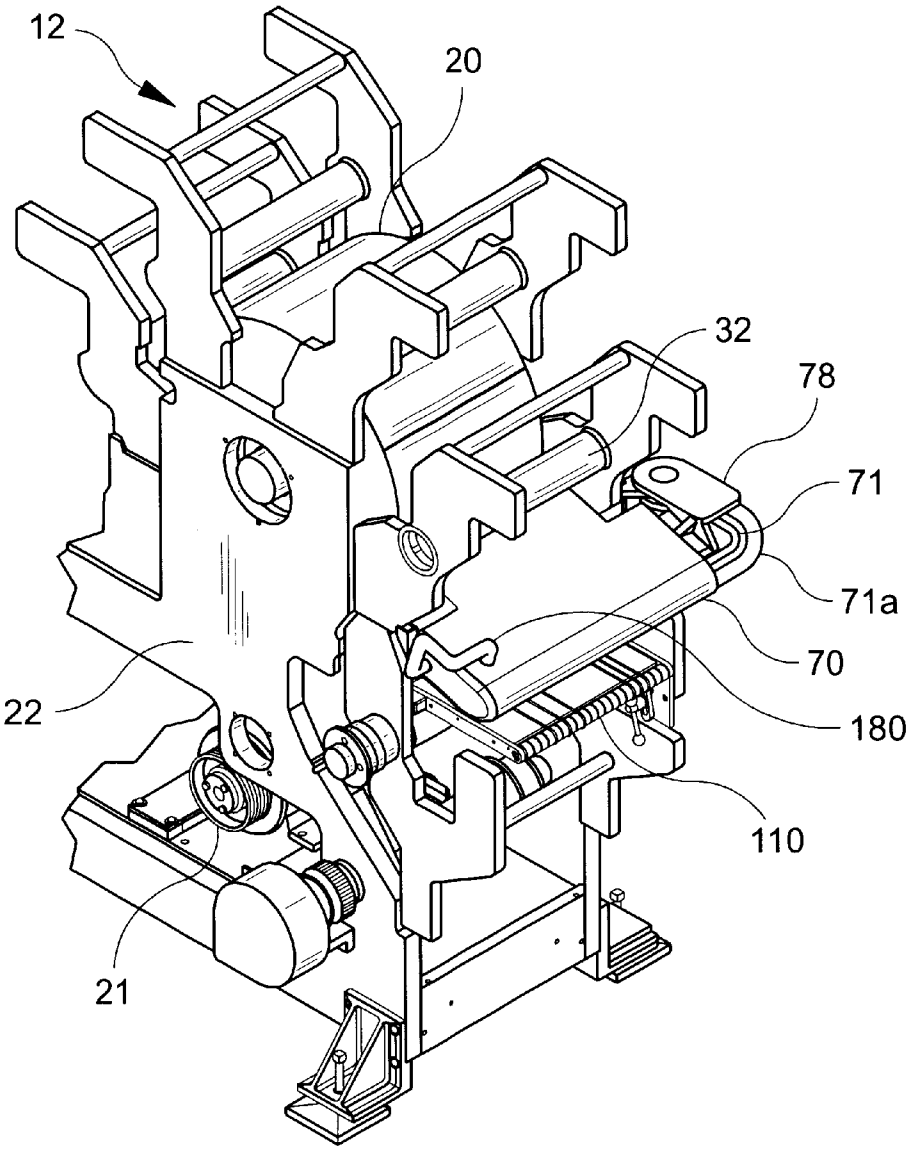
FIG. 7 is a side perspective view of the printing unit having portions removed for clarity showing an ink fixing device in the operative position.
Figure 8:
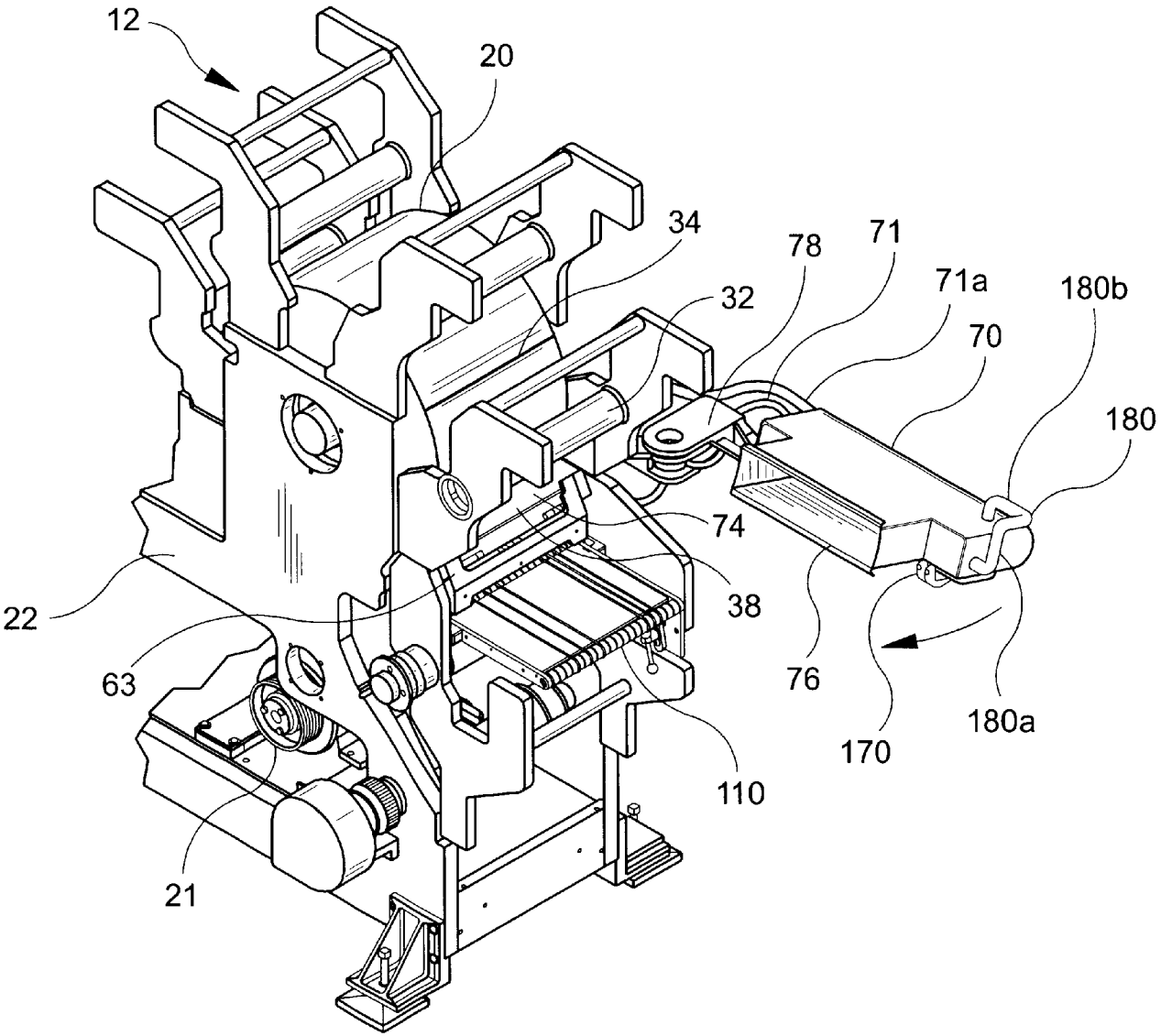
FIG. 8 is a side perspective view of the printing unit having portions removed for clarity showing the ink fixing device in a maintenance position.

With reference to FIGS. 2, 7 and 8, printing press 10 further preferably includes an ink fixing device 70 disposed on printing unit 12. Ink fixing device 70 fixes the ink deposited on the sheet to prevent smearing of the printed image. Once the ink is fixed, the printed surface may be contacted without corrupting the image. In the preferred embodiment, ink fixing device 70 may be disposed on printing unit 12 between perfecting station 36 and the immediately previous first side printing station 24. Therefore, after front side printing of the sheet 11 has been completed, the printed front side of the sheet is acted upon by ink fixing device 70 prior to the sheet engaging perfecting station 36. When a sheet passes through perfecting station 36 the printed front side is pressed against the blanket surface 39*a* of multi-purpose drum 38 as the reverse side is printed. If the ink deposited on the sheet front side is not fixed by this stage, the image on the front side can be corrupted leading to an unacceptable output. However, by fixing the ink on the front side of the sheet, smearing and blurring of the printed image is prevented. Placement of ink fixing device 70 prior to the perfecting stage of the printing process permits high speed outputs on the order of 30,000 sheets per hour. Such speeds would not be achievable if the front side ink has to be air dried prior to perfecting.

With additional reference to FIG. 3, in the preferred embodiment, ink fixing device 70 preferably includes what is known in the art as a cold ultraviolet, (UV), dryer. However, the present invention also contemplates other types of ink fixing devices such as those which rely on infrared energy or hot air to dry the ink. The cold UV dryer works in association with UV sensitive inks. Generated UV energy reacts with the ink resulting in almost immediate curing of the ink through a process known as photopolymerization in a manner that is well known in the art. Ink fixing device 70 includes a lamp head 72 that generates the UV light required. One type of lamp head that has been found to be suitable is marketed by PRI of Dallas, Tex. Lamp head 72 cooperates with a cooling system 73 that circulates de-ionized water in front of a bulb 72*a* in lamp head 72 in order to filter out the unwanted infrared portion of the spectrum and allow the desirable UV wavelengths to pass onto the printed surface. The absorption of the infrared wavelengths heats the water but allows relatively "cool" radiant energy to pass onto the printed sheets.

Ink fixing device 70 further includes a housing 77 which shields the lamp head and contains an air cooling plenum 72*b* which also assists in cooling lamp head 72. Service lines 71 including an exhaust hose 71*a* all exit from the side of housing 77. As shown in FIG. 2, exhaust hose 71*a* is routed within the housing of printing unit 12 and exits out the top to facilitate connection to an on-site ventilation system if required. Cooling system 73 including a refrigeration unit 75 and heat exchanger 75*a* is provided for cooling the heated water circulated through ink fixing device 70. In the preferred embodiment, the refrigeration unit 75 may also be used for producing chilled fluid for use in printing unit 12 to cool the rollers of printing stations 24 and 36 such that only one refrigeration unit is necessary. It is known in the art to cool the rollers of the printing stations in order to maintain the ink at the optimal temperature. However, by using a single refrigeration unit to cool both the lamp head 72 and printing unit 12, significant reductions in printing press size and manufacturing costs can be achieved.

Printing chamber 16 includes an opening 74 that exposes a portion of central impression drum 20 between the perfecting station 36 and the immediately proceeding front side printing station 24. Ink fixing device 70 has a front output portion 76 from which the UV energy emanates. Output portion 76 extends into opening 74 and is adjacent to central impression drum 20 such that the ink on the printed sheets travelling on drum 20 are exposed to the UV energy. Access to this portion of the printing chamber 16 is important in order to provide scheduled and unscheduled maintenance of multi-purpose drum 38 and the proceeding front side printing station 24. Therefore, in order to facilitative maintenance of ink fixing device 70 and the various elements disposed within printing chamber 16, ink fixing device 70 is preferably pivotally mounted to frame 22 of printing unit 12.

Ink fixing device 70 is preferably pivotable between an operative position and a maintenance position. In the operative position, ink fixing device 70 covers printing unit opening 74 thereby placing the front output portion 76 adjacent central impression drum 20 so that fixing of the printed sheets may take place. During operation of printing press 10, it at times becomes necessary to remove ink fixing device 70 for maintenance purposes, such as for cleaning various components or clearing a jam. When access to this portion of printing unit 12 is required, ink fixing device 70 may be rotated to the maintenance position, exposing opening 74 into the printing unit. This may easily be achieved by rotating ink fixing device 70 to the maintenance position. Access is then made available to a portion of central impression drum 20 and the cylinders and drums of the adjacent front side printing station 24 and perfecting station 36. While in the maintenance position, ink fixing device 70 is supported by frame 22, therefore, the press operator need not completely disconnect ink fixing device 70 from printing unit 12 and then reattach ink fixing device 70 after the servicing is completed. There is also no need to ensure that ink fixing device 70 is properly supported while off printing unit 12 so that control lines to ink fixing device 70 are not unduly strained or that the unit is not damaged. Accordingly, the time for servicing printing unit 12 is significantly reduced.

In the prior art printing presses, the ink fixing device or dryer was typically bolted onto a printing unit and removal required unfastening a series of bolts or other fastening hardware. The ink fixing device would then have to be properly supported while the bolts were being removed and after the unit was separated from the printing unit. Reattaching the ink fixing device would require it to be supported while the fastening hardware was reattached. Such a practice is time consuming and requires possibly two individuals to safely complete the task. In contrast, the present invention permits one operator to quickly and easily rotate ink fixing device 70 from the operative position to a maintenance position where access to a portion of printing chamber 16 is permitted. After maintenance is completed, ink fixing device 70 may easily be swung back to the operative position.

Figure 9:
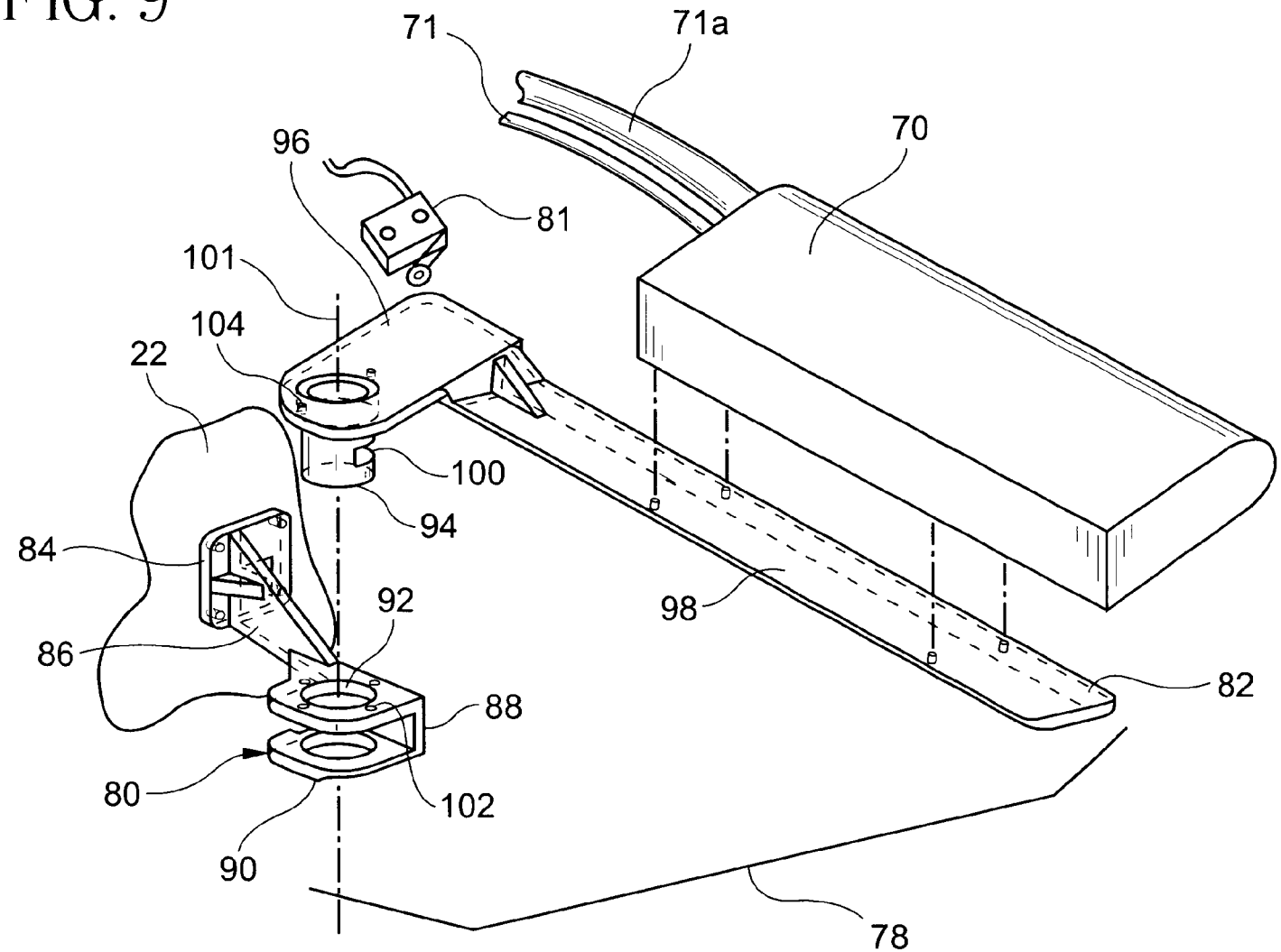
FIG. 9 is an exploded perspective view of the ink fixing device mounting bracket of the present invention.

In the preferred embodiment, the pivotal attachment of ink fixing device 70 to the printing unit includes a hinge 78 as shown in FIG. 9. Hinge 78 includes a bracket 80 that is fixedly secured to frame 22 of printing unit 12. Hinge 78 further includes an arm 82 that is fixedly attached to ink fixing device 70. Bracket 80 includes a mounting surface 84 that is fixedly securable to frame 22. Bracket mounting surface 84 is spaced by a rigid transition member 86 from a bracket pivot section 88. Pivot section 88 includes a pair of spaced flanges 90 having an aperture 92 extending there through. Flange apertures 92 are configured to receive a hollow sleeve 94 extending from a pivot end 96 of arm 82. Sleeve 94 includes a circumferentially extending slot 100 extending through the sleeve. Arm 82 further includes an elongate portion 98 upon which ink fixing device 70 is secured. When arm 82 is operatively connected to bracket 80, sleeve 94 rotates within flange apertures 92. Slot 100 is disposed between flanges 90 thereby forming a passage through hinge 78 adjacent axis of rotation 101 to accommodate the service lines 71 such as cooling, control and power lines used for operating ink fixing device 70.

Hinge 78 may include one or more detent positions to maintain ink fixing device 70 in a selected predetermined orientation. For example, the preferred embodiment a detent is formed such that ink fixing device 70 is held in the maintenance position. The detent may be formed by cooperating spring-loaded balls 102 and divots 104 in the opposed contacting surfaces of the bracket and arm. It is understood that a variety of different mechanisms can be employed in order to provide the detent feature as is well known in the art. In addition, a lock-out 81 in the form of a mechanical switch may be employed adjacent hinge axis of rotation 101 such that it will be actuated by arm 82 upon moving ink fixing device 70 out of the operative position. Lock-out 81 is operatively connected to the printing press controls such that upon actuation of lock-out 81, printing press 10 including ink fixing device 70 would be shut down. Lock-out 81 may be positioned within the printing unit housing to prevent tampering.

Figure 10:
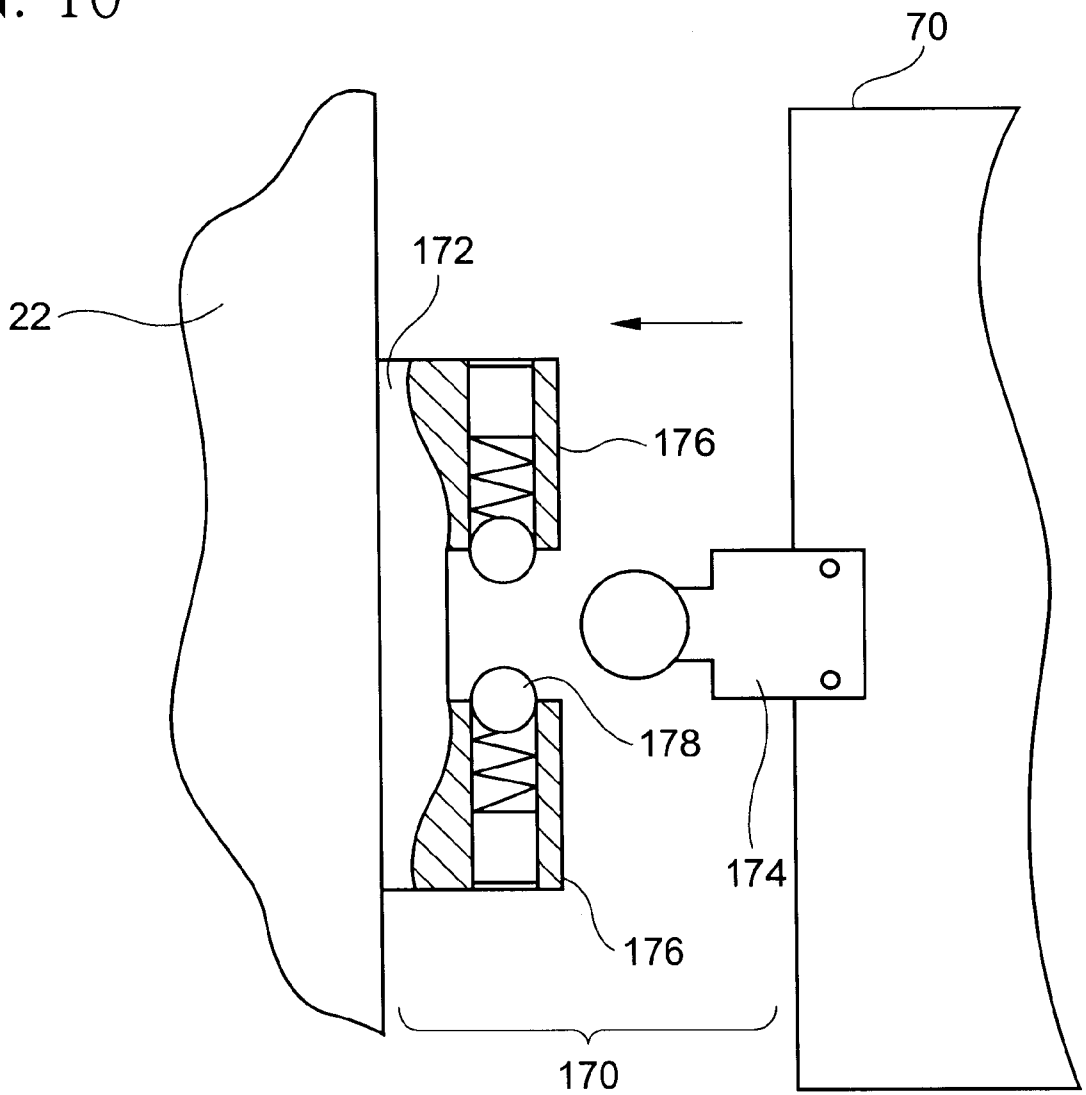
FIG. 10 is a side elevational view of the latch for the ink fixing device.

Ink fixing device 70 may be held in the operative or closed position by a latch 170 that both securely retains ink fixing device 70 in the operative position and provides vertical support for its cantilevered end. As shown in FIG. 10, latch 170 includes a U-shaped catch 172 attached to frame 22 and a strike 174 attached to the cantilevered end of ink fixing device 70. Catch 172 includes a pair of spaced arms 176 that each support a spring loaded projections 178. Strike 174 is sized to be inserted between arms 176 and engage biased projections 178 such that strike 174 is retained. Arms 176 also provide support against vertical loadings which may be imparted on ink fixing unit. The retaining force of latch 170 may be overcome by firmly pulling ink fixing device 70 toward its maintenance position. One type of catch which has been found to provide suitable results is a ball-style tension catch P/N 1790A17 marketed by McMaster-Carr of New Jersey. It is also within the contemplation of the present invention that a variety of latches may be used in order to retain ink fixing unit in its operative position.

To assist in rotating ink fixing unit 70 between the operative and maintenance positions, ink fixing device may include a handle 180 secured thereto. Handle 180 is preferably formed so as to permit engagement by an operator from a variety of approaches. As shown in FIG. 7, handle 180 has a side portion 180*a* that at one end is attached to ink fixing device 70 and extends upwardly above ink fixing device 70. Handle 180 then extends substantially parallel to a side of ink fixing device 70 and then over ink fixing device 70 form a top portion 180*b*. One end of top portion 180*b* is secured to the top of ink fixing device 70. Such a handle 180 permits ink fixing device 70 to be easily grabbed from either the top or side in order to accommodate an operator who may be positioned either to the side or in front of ink fixing device 70.

Figure 11:
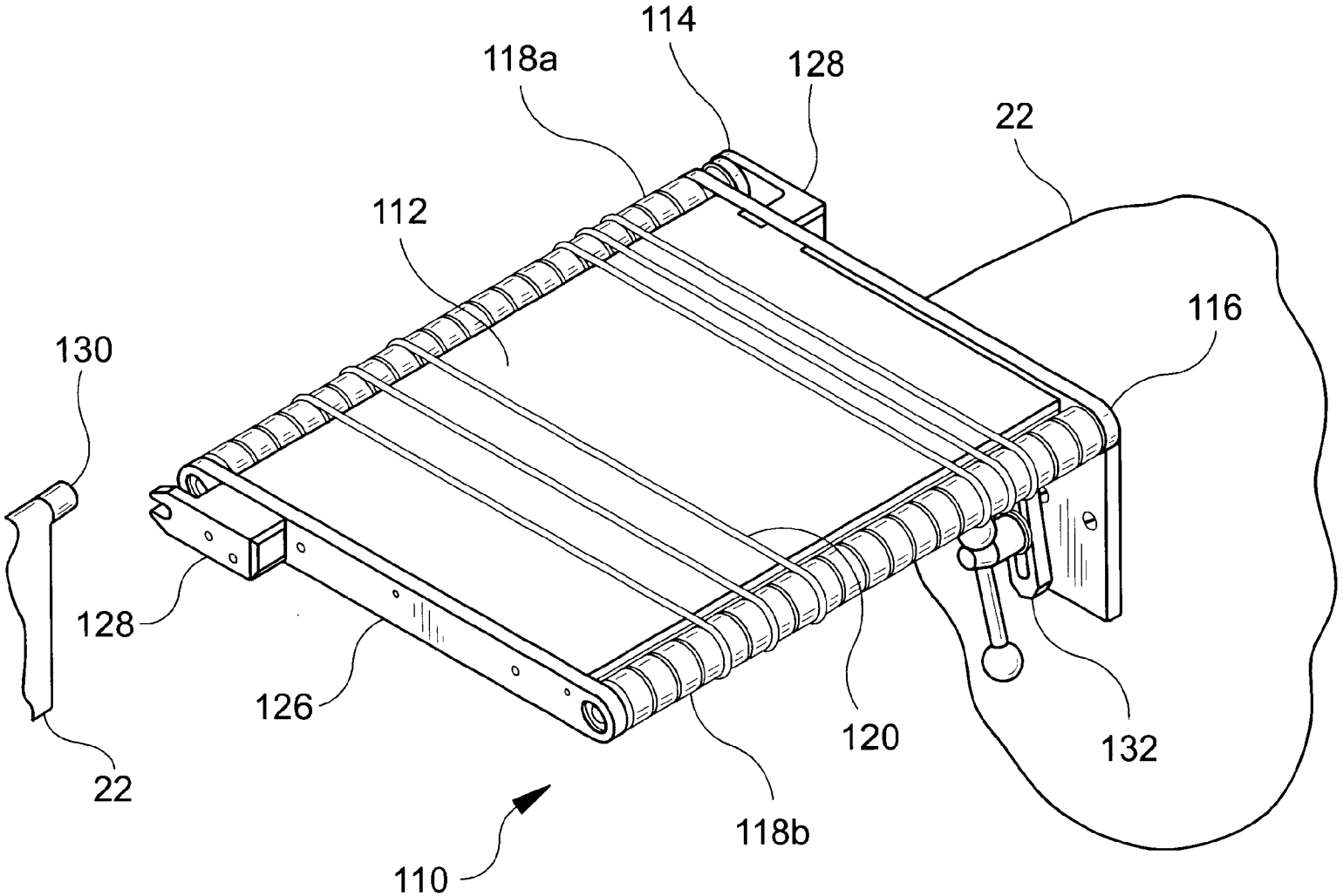
FIG. 11 is a top perspective view of the output table of the present invention.

Referring to FIGS. 3 and 11, printing unit 12 further includes an exit station 109 where printed sheets exit printing unit 12. Exit station 109 includes an output table 110 for receiving printed sheets exiting off of multi-purpose drum 38 and transporting them out of printing unit 12 to delivery table 14 where the printed material is collected. Output table 110 includes a conveying surface 112 for supporting and transporting the printed sheets to delivery table 14. In the preferred embodiment, output table 110 includes a first 114 and second 116 end each having a laterally extending roller 118*a* and 118*b*, respectively, rotatably supported on delivery table 110. Conveying surface 112 includes a plurality of spaced elastic bands 120, such as o-rings, that extend about rollers 118*a* and 118*b* and move in unison therewith. Rollers 118 and bands 120 extending thereabout are driven by a transmission element 122, such as a belt, extending between front roller 118*a* and a gear 124 that may be mechanically connected to the rotation of the multi-purpose drum 38. Accordingly, the rotational speed of multi-purpose drum 38 and conveying surface 112 are directly linked. This is advantageous since as the speed of multi-purpose drum 38 changes so does the discharge frequency of the sheets which must be accommodated by output table 110. The mechanical connection provides for a linear speed of conveying surface 112 so that printed sheets 11 will be transported without overlapping in order to prevent smearing of the reverse side printed image.

Output table 110 may be connected to printing unit 12 such that it is both pivotally adjustable and easily removable from printing unit 12. To achieve such a connection, output table may include a frame 126 having two spaced forks 128 adapted to engage pins 130 extending from frame 22. Pins 130 sit within forks 128 thereby providing a rotational coupling of the output table to the printing unit. A slotted attachment device 132 may be attached to one side of output table second end 116 to provide an adjustable attachment to frame 22. A second attachment device (not shown) may also be provided on the other side of output table second end 116. Accordingly, the angle of output table 110 can be adjusted to properly align with delivery table 14. Output table 110 may easily be removed by disconnecting the transmission element 122 and attachment device 132 and uncoupling forks 128 from pins 130. The ability to remove the output table permits access to the printing unit at a point adjacent to multi-purpose cylinder 36 and corresponding plate and blanket cylinders 42 and 40.

Figure 12:
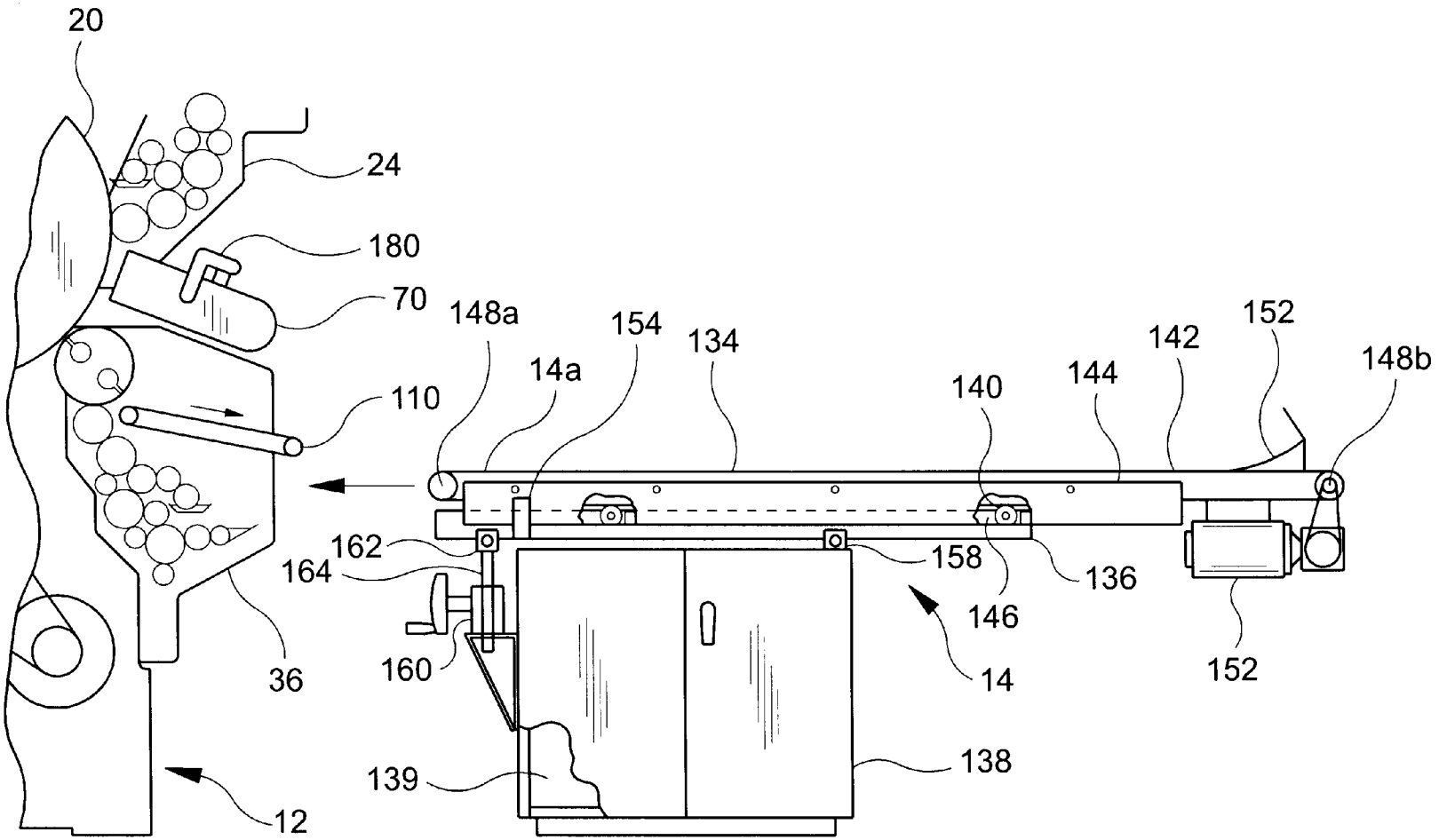
FIG. 12 is a side elevational schematic view of the delivery table in the retracted position.
Figure 13:
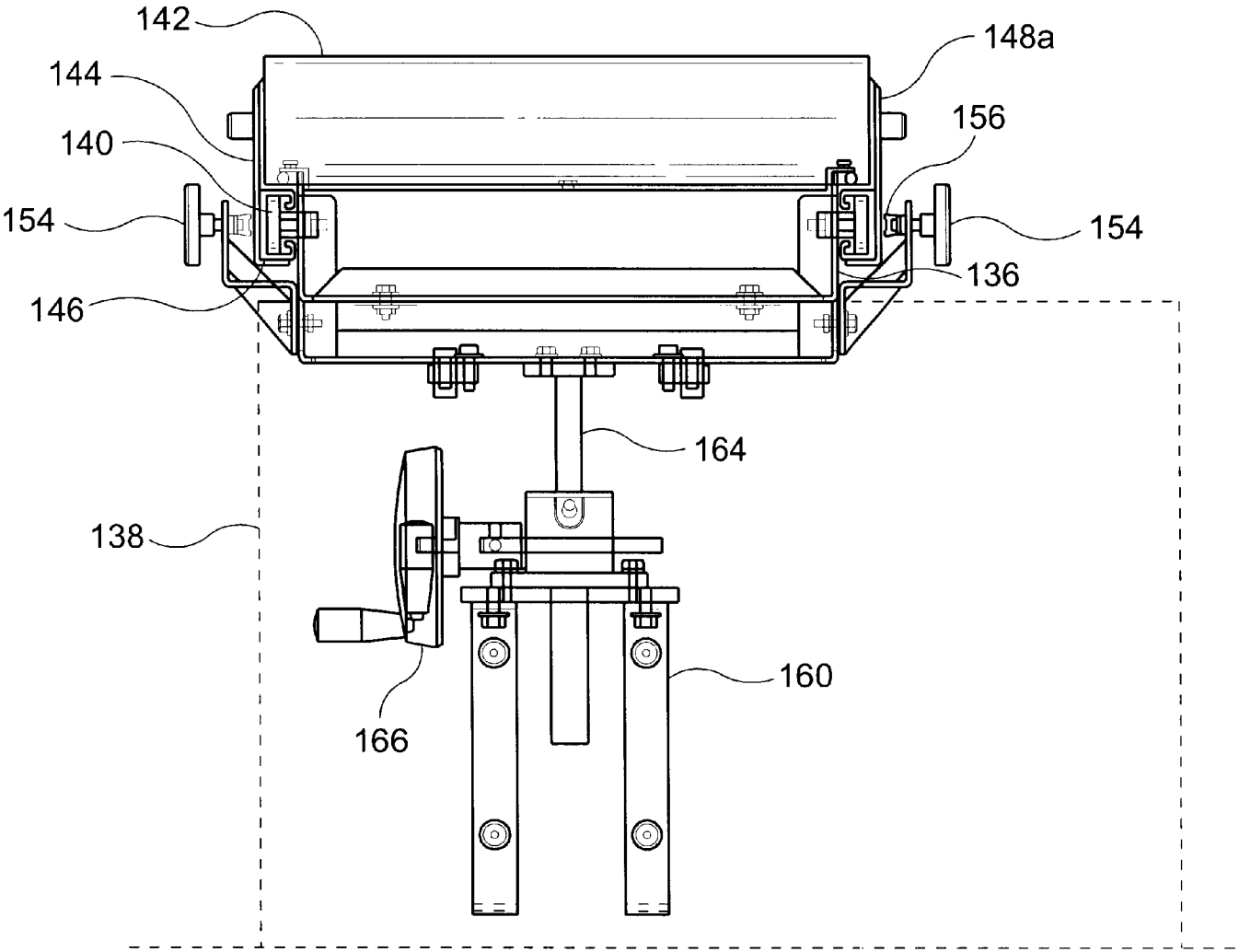
FIG. 13 is a back end view of the delivery table of the present invention showing the base in phantom for clarity.

With reference to FIGS. 1, 12 and 13, printed sheets 11 are transported out of printing unit 12 onto delivery table 14 which is positioned adjacent output table second end 116. Delivery table 14 includes a conveyer 134 for moving printed sheets to a collection point where the sheets may be removed from printing press 10.

Delivery tables of the prior art were typically fixed to the floor or some immovable base. Therefore, access to the exit station of the press adjacent the front end of the delivery table was obstructed by the table. The present invention overcomes the prior art limitations by permitting delivery table to translate. In order to facilitate access to printing unit 12, delivery table 14 may be translatable between an extended operative position adjacent exit station 109 for receiving sheets coming off of output table 110, and a retracted maintenance position for permitting access to printing unit 12. Accordingly, when an operator requires access to the section of printing unit 12 adjacent the area of output table 110 and perfecting unit, delivery table 14 may be moved into the retracted position such that there is room to stand directly in front of this portion of printing unit 12.

Referring specifically to FIGS. 12 and 13, in order to permit delivery table 14 to be extended and retracted, the delivery table includes an elongate support 136 translatably fixed to a base 138. Base 138 may provide a housing for an electrical controller 139 operatively connected to ink fixing device 70 used to operate ink fixing device 70. This results in a significant reduction in floor space needed to accommodate printing press 10. Table elongate support 136 may include a plurality of longitudinally spaced rollers 140 extending outwardly therefrom. Delivery table further includes a translatable portion 142 longitudinally aligned with elongate support 136. Translatable portion 142 may include a pair of spaced downwardly extending side walls 144 extending along a length of translatable portion 142. Each side wall includes a track 146 extending therefrom configured to ride on rollers 140. This arrangement permits table translatable portion to move between the extended and retracted positions. It is also within the contemplation of the present invention that the linear translatable feature delivery table 14 may be accommodated by a variety of mechanical devices including linear bearings, slides and various roller configurations. In addition, rollers 140 may be rotatably fixed to translatable portion 142 and ride on a track or surface of the elongate support 136 (FIG. 2).

Conveyer 134 is disposed on table translatable portion 142 and moves therewith. Table translatable portion 142 includes a front and rear wheel 148*a* and 148*b* rotatably secured to each end of thereof. A plurality of spaced fabric reinforced belts 150 (FIG. 1) extend around table translatable portion 142 and in operative engagement with wheels 148*a* and 148*b*. Wheel 148*a* disposed at the back of translatable portion 142 is preferably operatively connected to a drive unit 152, such as a motor, to move belts 150 along the table. The moving belts 150 move along table 14 and carrying the printed sheets 11 to the back end of the table where they engage a stacking ramp 152 and begin to form a stack of printed sheets. At this point, the sheets may be collected and removed from printing press 10.

In order to secure delivery table 14 in either the extended or retracted position, a locking device 154 may be employed. In the preferred embodiment, the locking device may include a threaded device supported by delivery table elongate support 136. Advancement of the thread causes the engagement of the working end 156 of the threaded device with the surface of the opposed translatable portion side walls 144.

In addition, the height of delivery table 14 may be adjusted so that delivery table front end 14*a*, disposed adjacent to output table 110, may be positioned to receive sheets coming off of output table 110. In order to provide this degree of adjustment, elongate support 136 may be pivotally attached to base 138 at a first pivot point 158 and pivotally attached to a height adjuster 160 at a second pivot point 162 disposed closer to table front end then first pivot point 158. Height adjuster 160 may include a member 164 that may be selectively moved up or down thereby raising or lowering table leading end 14*a*. The movement may be provided by a jack screw device secured to base 138 wherein a turn of a wheel 166 causes member 164 to move up or down. The member 164 may then be held in the desired position when the proper height has been reached.

Accordingly, the delivery table of the present invention permits the table to be moved out of the way to allow an operator to stand between the printing unit and the delivery table to aid in servicing the press. An operator may also easily adjust the delivery table 14 such that printed sheets exiting the printing unit 16 properly engage delivery table 14.

Thus, while there had been described what are presently believed to be the preferred embodiments for the present invention, other and further modification and changes can be made thereto without departing from the true spirit of the invention. It is intended to include all further and other modifications and changes that come within the true scope of the invention as set forth in the claims.

What is claimed:

1. A printing press comprising:

a frame;

a central impression drum rotatably supported on said frame and adapted to transport a sheet;

a plurality of first side printing stations circumferentially spaced about said central impression drum and in communication therewith for printing an image on a first side of a substrate;

a perfecting printing station disposed at a position about said central impression drum, said perfecting printing station including a multi-purpose drum having a substrate retainer for securing the substrate thereto, said multi-purpose drum forming an impression cylinder and being in communication with an image transfer cylinder for imparting an image on a second side of the substrate; and an ink fixing device disposed between said first side printing stations and said perfecting station for fixing the image on the first side of the substrate prior to the image being imparted on the second side of the substrate by said perfecting station.

2. The printing press as defined in claim 1, wherein said ink fixing device is pivotally secured to said frame and rotatable between a first position and a second position.

3. The printing press as defined in claim 2, further including an access opening to permit access to said central impression drum, said access opening being disposed adjacent to said ink fixing device such that said ink fixing device covers said access opening when in said first position and exposes said access opening when in said second position thereby permitting access to said central impression drum.

4. The printing press as defined in claim 2, further including a hinge, said hinge rotatably securing said ink fixing unit to said frame, said hinge including a bracket fixedly secured to said frame and an arm fixedly secured to said ink fixing device, said arm including a portion rotatably engaged with said bracket to permit rotation between said bracket and said arm.

5. The printing press as defined in claim 4, wherein said hinge includes an axis of rotation, and a passage there through adjacent said axis of rotation to permit ink fixing unit service lines to extend through said hinge.

6. The printing mechanism as defined in claim 5, wherein said hinge includes a detent which maintains said ink fixing device in the second position.

7. The printing press as defined in claim 1, wherein said ink fixing device includes an ultraviolet transmission device for imparting ultraviolet light on the substrate.

8. The printing press as defined in claim 1, further including a delivery table positionable adjacent to said perfecting unit for receiving the printed substrate and transferring the printed substrate to a collection point.

9. The printing press as defined in claim 8, wherein the delivery table is translatable between an extended and retracted position, such that when said delivery table is in said extended position, said delivery table is positioned adjacent said perfecting station to receive the substrate exiting therefrom and when said delivery table is in said retracted position, access is provided to permit an operator to stand between said delivery table and said central impression drum.

10. The printing press as defined in claim 1, wherein said first substrate retainer includes a plurality of first ports extending along a length of said multi-purpose drum, and said first ports are selectively in fluid communication with a vacuum source.

11. The printing press as defined in claim 10, further including a valve disposed between said plurality of first ports and said vacuum source such that vacuum may be selectively applied to said plurality of first ports to retain the sheet on said multi-purpose drum.

12. The printing press as defined in claim 11, further including a positive pressure source and wherein said plurality of first ports are selectively in communication with said positive pressure source such that the sheet may be separated from said multi-purpose drum.

13. The printing press as defined in claim 10, wherein said first ports are in communication with a vacuum source over a first part of the rotation of multi-purpose drum to retain the sheet and said first ports are in communication with a positive pressure source over a second part of the rotation of multi-purpose drum to release the sheet.

14. The printing press as defined in claim 10, wherein said multi-purpose drum includes a second sheet retainer including a plurality of second ports extending along the length of said multi-purpose drum substantially diametrically opposed from said plurality of first ports.

15. A printing press comprising:

a printing unit including;

a frame;

a central impression drum rotatably supported on said frame adapted to transport a sheet;

a plurality of first side printing stations circumferentially spaced about said central impression drum and in communication therewith, said first side printing stations adapted to impart an image to a first side of the sheet being transported by said central impression drum;

a perfecting printing station disposed about said central impression drum sequentially after said plurality of first side printing stations for imparting an image to a second side of the sheet, said perfecting printing station including a multi-purpose drum having a first sheet retainer attached thereto for securing the sheet to said multi-purpose drum, said multi-purpose drum forming an impression cylinder and being in rolling communication with an image transfer cylinder for printing an image on the second side of the sheet.

16. The printing press as defined in claim 15, wherein said first sheet retainer is integral with said multipurpose drum and remains on said multi-purpose drum throughout a rotation thereof.

17. The printing press as defined in claim 15, wherein said first sheet retainer includes a plurality of first ports spaced along a portion of a length of said multi-purpose drum and being selectively in communication with a vacuum source for providing vacuum to said plurality of first ports.

18. The printing press as defined in claim 17, further including a positive pressure source and wherein said plurality of first ports are selectively in communication with said positive pressure source such that the sheet may be separated from said multi-purpose drum.

19. The printing press as defined in claim 17, wherein said multi-purpose drum includes a second sheet retainer diametrically opposed from said first retainer such that said multi-purpose drum can process a plurality of sheets simultaneously.

20. The printing press as defined in claim 15, wherein said multipurpose drum includes a first set of spaced pockets extending along a length thereof, said first set of pockets being sized to receive grippers disposed on said central impression drum.

21. The printing press as defined in claim 15, wherein said printing unit further includes an ink fixing device an ink fixing device disposed between said first side printing stations and said perfecting station for fixing the image on the first side of the sheet prior to the image being imparted to the second side of the substrate by said perfecting station.

22. The printing press as defined in claim 21, wherein said ink fixing device is pivotally secured to said frame by a hinge and rotatable between a first position and a second position.

23. The printing press as defined in claim 15, further including a delivery table positionable adjacent to said printing unit for receiving the printed sheets exiting therefrom, said delivery table transferring the printed sheets to a collection point.

24. The printing press as defined in claim 23, wherein said delivery table is translatable between an extended and retracted position, such that when said delivery table is in said extended position, said delivery table is positioned adjacent said printing unit to receive the substrate exiting therefrom and when said delivery table is in said retracted position access is provided to permit an operator to stand between said delivery table and said printing unit.

25. The printing press as defined in claim 23, wherein said printing unit further includes an output table adapted to transport a sheet out of said printing unit, said output table being removably secured to said frame and disposed between said multi-purpose drum and said delivery table.

26. A printing press comprising:

a frame;

a central impression drum rotatably supported on said frame and adapted to transport a sheet;

a plurality of first side printing stations circumferentially spaced about said central impression drum and in communication therewith for printing an image on a first side of a substrate;

an ink fixing device for fixing the image on the first side of the substrate being pivotally secured to said frame and rotatable between a first position and a second position; and a hinge rotatably securing said ink fixing unit to said frame, said hinge including a bracket fixedly secured to said frame and an arm fixedly secured to said ink fixing device, said arm including a portion rotatably engaged with said bracket to permit rotation between said bracket and said arm.

27. The printing press as defined in claim 26, further including an access opening to permit access to said central impression drum, said access opening being disposed adjacent to said ink fixing device such that said ink fixing device covers said access opening when in said first position and exposes said access opening when in said second position thereby permitting access to said central impression drum.

28. The printing press as defined in claim 26, further including a hinge, said hinge rotatably securing said ink fixing unit to said frame, said hinge including a bracket fixedly secured to said frame and an arm fixedly secured to said ink fixing device, said arm including a portion rotatably engaged with said bracket to permit rotation between said bracket and said arm.

29. The printing press as defined in claim 26, further including a perfecting printing station disposed at a position about said central impression drum, said perfecting printing station including a multi-purpose drum having a means for retaining the substrate for securing the substrate thereto, said multi-purpose drum forming an impression cylinder and being in communication with an image transfer cylinder for imparting an image on a second side of the substrate.

30. The printing press as defined in claim 29, wherein said ink fixing device is disposed between said first side printing stations and said perfecting station for fixing the image on the first side of the substrate prior to the image being imparted on the second side of the substrate by said perfecting station.

31. A printing press comprising:

a frame;

a central impression drum rotatably supported on said frame and adapted to transport a sheet;

a plurality of first side printing stations circumferentially spaced about said central impression drum and in communication therewith for printing an image on a first side of a substrate;

an ink fixing device for fixing the image on the first side of the substrate being pivotally secured to said frame and rotatable between a first position and a second position; and an access opening to permit access to said central impression drum, said access opening being disposed adjacent to said ink fixing device such that said ink fixing device covers said access opening when in said first position and exposes said access opening when in said second position thereby permitting access to said central impression drum.

32. A printing press comprising:

a frame;

a central impression drum rotatably supported on said frame and adapted to transport a sheet;

a plurality of first side printing stations circumferentially spaced about said central impression drum and in communication therewith for printing an image on a first side of a substrate;

an ink fixing device for fixing the image on the first side of the substrate being pivotally secured to said frame and rotatable between a first position and a second position;

a perfecting printing station disposed at a position about said central impression drum, said perfecting printing station including a multi-purpose drum having a means for retaining the substrate for securing the substrate thereto, said multi-purpose drum forming an impression cylinder and being in communication with an image transfer cylinder for imparting an image on a second side of the substrate, and said ink fixing device being disposed between said first side printing stations and said perfecting station for fixing the image on the first side of the substrate prior to the image being imparted on the second side of the substrate by said perfecting station.

33. A printing press comprising:

a frame;

a central impression drum rotatably supported on said frame and adapted to transport a sheet;

a plurality of first side printing stations circumferentially spaced about said central impression drum and in communication therewith for printing an image on a first side of a substrate;

a perfecting printing station disposed at a position about said central impression drum; and an ink fixing device for fixing the image on the first side of the substrate being pivotally secured to said frame and rotatable between a first position and a second position, said ink fixing device being disposed between said first side printing stations and said perfecting station for fixing the image on the first side of the substrate prior to the image being imparted on the second side of the substrate by said perfecting station.

* * * * *

UNITED STATES PATENT AND TRADEMARK OFFICE

CERTIFICATE OF CORRECTION

PATENT NO. : 6,401,608 B1 
DATED : August 14, 2002
INVENTOR(S) : Lyon et al.

It is certified that error appears in the above-identified patent and that said Letters Patent is hereby corrected as shown below:

Title page,
Item [74], *Attorney, Agent or Firm*, now reads "Hoffman & Baron, LLP", should read -- Hoffmann & Baron, LLP --.

Column 2,
Line 47, now reads "to allow case of maintenance", should read -- to allow ease of maintenance --.

Column 15,
Lines 4-5, now reads "includes an ink fixing device an ink fixing device disposed", should read -- includes an ink fixing device disposed --.

Signed and Sealed this

Tenth Day of December, 2002

JAMES E. ROGAN
*Director of the United States Patent and Trademark Office*